United States Patent [19]

Wilson et al.

[11] Patent Number: 4,813,123

[45] Date of Patent: Mar. 21, 1989

[54] METHOD OF ADJUSTING AN ELECTRIC HORN AIR GAP

[75] Inventors: Carl R. Wilson, Texico; James A. Neese, Flora, both of Ill.

[73] Assignee: Sparton Corporation, Jackson, Mich.

[21] Appl. No.: 148,380

[22] Filed: Jan. 25, 1988

[51] Int. Cl.[4] ..... H04R 31/00

[52] U.S. Cl. ..... 29/593; 29/594; 29/609.1

[58] Field of Search ..... 29/594, 602 A, 602 R, 29/622, 593, 169.5, 609.1; 116/142 R

[56] References Cited

U.S. PATENT DOCUMENTS

| | | | |
|---|---|---|---|
| 3,516,088 | 6/1970 | Allport | 29/594 X |
| 3,864,823 | 2/1975 | Berns | 29/602 |
| 4,135,473 | 1/1979 | Frigo | 29/594 X |
| 4,361,952 | 12/1982 | Neese | 29/594 |

*Primary Examiner*—Carl E. Hall

*Attorney, Agent, or Firm*—Reising, Ethington, Barnard, Perry & Milton

[57] ABSTRACT

An electric horn has a diaphragm driven by a plunger which is vibrated by a coil having a pole piece. A small air gap between the plunger and the pole piece is required to assure that they will not touch during vibration. The gap is adjusted by assembling the horn with the gap small enough to permit the plunger to be pulled into contact with the pole piece by magnetic force when a preset direct current is applied to the coil. After assembly a calibration procedure is to apply the preset current to the coil, mechanically pull the pole piece away from the plunger until the diaphragm force overcomes the magnetic force causing the plunger and pole piece to separate, electrically detect the time of separation, and then stop or optionally pull the pole piece an additional fixed amount to set the required gap. Apparatus automatically performs the calibration procedure.

8 Claims, 2 Drawing Sheets

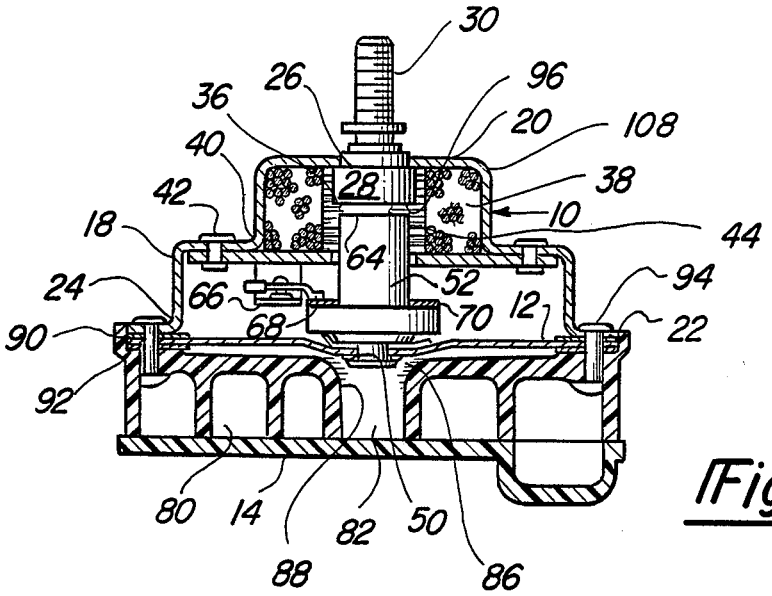
Fig-1
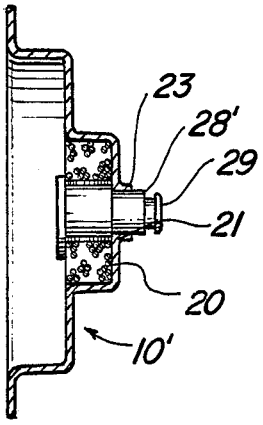
Fig-2
Fig-4
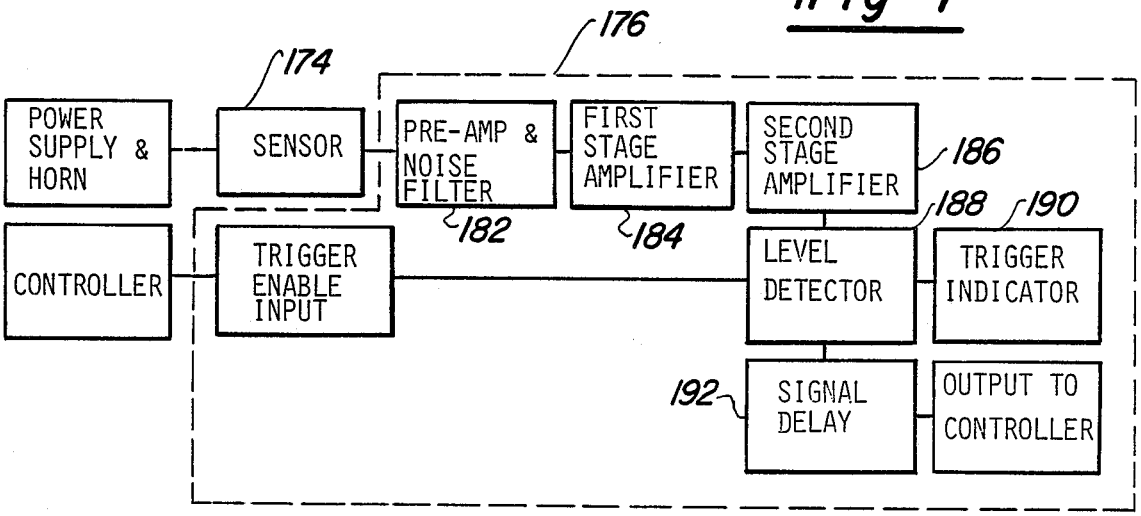

METHOD OF ADJUSTING AN ELECTRIC HORN AIR GAP

FIELD OF THE INVENTION

This invention relates to a method of adjusting a gap in an electric horn and particularly to such a method applicable to the horn after assembly.

BACKGROUND OF THE INVENTION

Electric horns such as those used on automotive vehicles have a plunger/diaphragm assembly which is vibrated by magnetic impulses generated in a coil/pole piece assembly. The displacement of the vibrating diaphragm and the sound output level depends at least in part on the size of an air gap which separates the plunger and the pole piece. Due to manufacturing variations the gap cannot reliably be controlled in a mass production basis unless each horn is calibrated individually.

Automobile horns are mass produced and cost of manufacture is closely controlled and high production fabrication and assembly techniques are employed in their manufacture. The metal housing in which the electromagnetic coil is mounted is formed of drawn sheet metal, and this drawing fabrication step does not result in an accurately dimensioned housing due to variations in the metal ductility, and "spring back". In another embodiment parts are held by a friction fit and are slidably movable. Therefore, due to the difficulty of maintaining accurate manufacturing tolerances, electromagnetic vehicle horns will vary in the level of sound output if adjustment means are not utilized to overcome such tolerance variations.

Adjustment of the air gap between the pole piece and diaphragm plunger by the use of extra components, or machined surfaces, threads, etc. adds significant cost to the manufacture. In U.S. Pat. No. 4,135,473 a method of horn adjustment is disclosed Wherein the axial dimension of the housing is varied by deforming the housing sidewalls by regulating the dimension of a radially extending housing sidewall ridge. The disclosure of this patent permits the horn air gap to be adjusted after the horn components are completely assembled, and operating tests requiring continuous operator evaluation for individual horns are used to determine the correct adjustment. However, the techniques disclosed in this patent are relatively expensive to practice due to the time involved, and the complexity of the apparatus employed.

Another approach to the control of the air gap dimension is presented in the U.S. Pat. No. 4,361,952 to Neese. There it is taught to measure the critical dimensions of parts which affect the air gap and to make the necessary adjustments before assembly. That practice does not take into account the thickness variations of the diaphragm which affect its flexibility and its amplitude of movement. Thus for a fixed nominal gap, a small diaphragm amplitude would result in a larger effective gap at the closest approach of the plunger to the pole piece. Accordingly a functional test which takes into account more factors than the bare dimensions is more appropriate to the optimal adjustment of air gap. Moreover, it is preferable to avoid the measurement of multiple parts if the gap can be obtained in a more direct fashion.

In practice the functional test is practiced by manual adjustment of each horn after assembly. The horn is initially made with a slightly oversize air gap. Then the horn is energized by applying a standard voltage to the coil and a db meter measures and displays the horn output sound level. The operator adjusts the horn gap by forcing the plunger in until the requisite sound level is attained. In a subsequent test the operator increases the applied voltage to a specified voltage limit and listens to the sound quality to determine whether the plunger contacts the pole piece.

SUMMARY OF THE INVENTION

It is therefore an object of the invention to provide a method of automatically adjusting the gap in an electric horn after assembly of the horn components. It is a further object to provide such a method which takes into account horn component variables other than dimensional variables to arrive at a desired gap.

The invention is carried out by the method of adjusting the gap between the plunger and the pole piece of an electric horn comprising the steps of; initially establishing the distance between the pole piece and the plunger at a value less than the desired gap, applying a predetermined direct current to the horn coil, the current being sufficient to bring the plunger into contact with the pole piece, moving the pole piece in a direction to break the contact with the plunger, and moving the pole piece any required additional amount after breaking the contact with the plunger to obtain the desired gap.

BRIEF DESCRIPTION OF THE DRAWINGS

The above and other advantages of the invention will become more apparent from the following description taken in conjunction with the accompanying drawings wherein like references refer to like parts and wherein:

FIG. 1 is a sectional elevation of a horn subject to adjustment by the method of the invention;

FIG. 2 is a sectional elevation of a partial horn housing of another type of horn structure subject to adjustment by the method of the invention;

FIG. 4 is a block diagram of a detector circuit used in the circuit of FIG. 3.

DESCRIPTION OF THE PREFERRED EMBODIMENT

Figure 3:
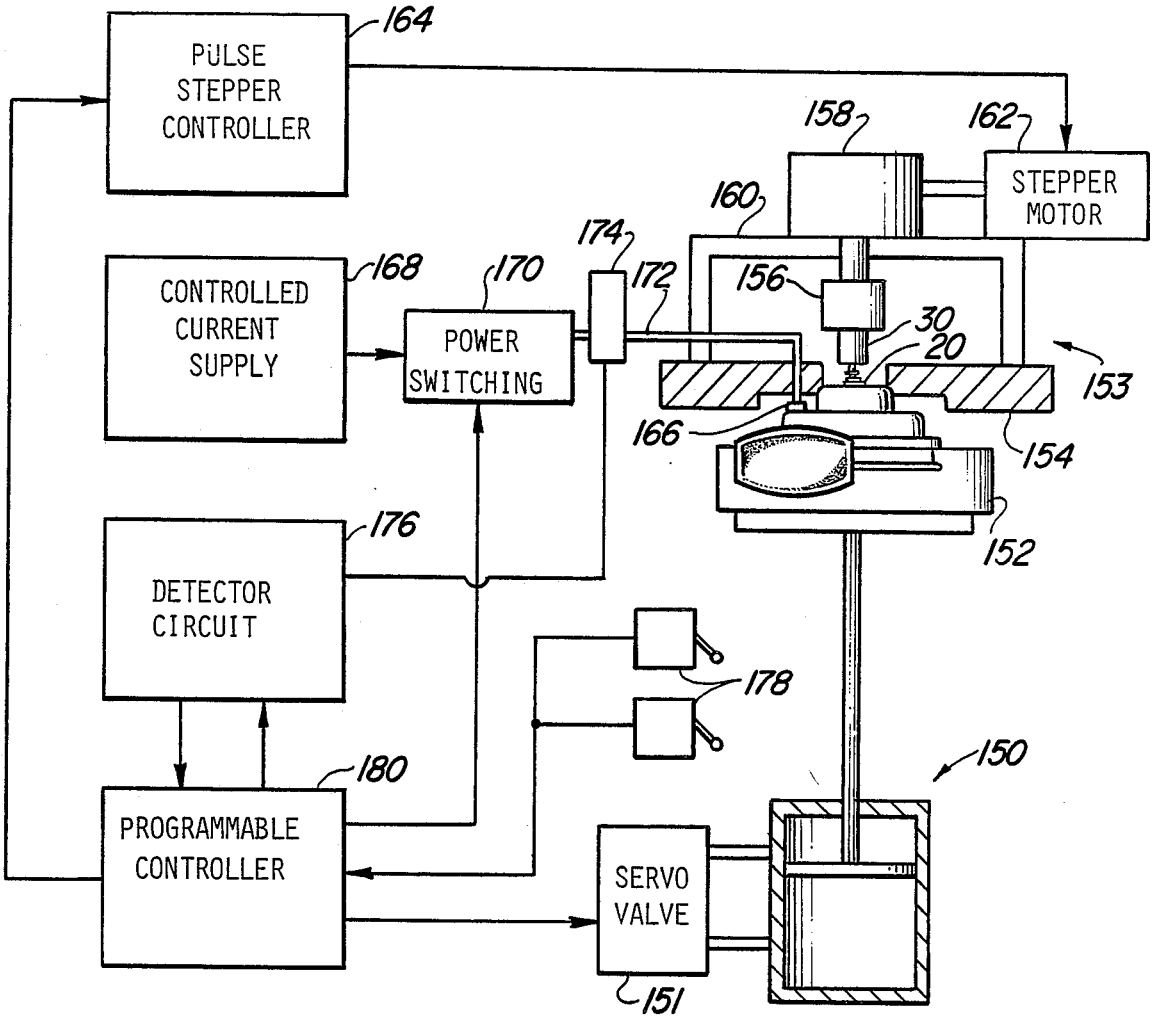
FIG. 3 is a schematic apparatus and circuit drawing of an apparatus used for carrying out the method of the invention.

A typical horn to which the method of the invention is applied is the same as that disclosed in the above mentioned patent U.S. Pat. No. 4,361,952. As shown in FIG. 1, the horn has a sheet metal housing 10, a diaphragm 12, and a projector 14. The sheet metal housing 10 is formed by a progressive drawing process and includes a stepped sidewall 18 and a relatively flat bottom wall 20. The sidewall 18 terminates in an annular radially extending flange 22 having a flat diaphragm assembly mounting surface 24, The bottom wall 20 includes a circular opening in which the ferromagnetic pole piece 28 is staked, and thereby affixed to the housing, The pole piece includes a threaded stem 30 for mounting purposes. The pole piece 28 also includes a flat radial inner end surface 36 which defines one side of the air gap surface, as later described.

An electromagnetic coil 38 is fixed within the housing 10 adjacent the bottom wall 20, and the coil is maintained in position by annular mounting plate 40 affixed to the housing by rivets 42. The coil 38 includes a central cylindrical bore 44 in which the pole piece 28 is located.

The diaphragm 12 includes a central opening 50 for permitting attachment of a ferromagnetic plunger 52 thereto. The plunger 52 is of a stepped cylindrical configuration having one end attached to the diaphragm 12 and another end which extends into the coil opening. The latter end 62 is of a radial flat configuration to form surface 64 which, along with surface 36, defines the air gap.

An electric switch 66 includes a member 68 engaging an insulated washer 70 mounted upon the plunger whereby movement of the plunger opens and closes the contacts of the switch 66 which controls energization of the coil 38. This switching arrangement is optional since an electronic switching circuit mounted externally of the horn is a viable alternative.

The projector 14 is preferably of a synthetic plastic material and includes a spirally oriented passage 80 having an inlet 82 coaxially related to the axis of the diaphragm 12, and the enlarged bell 84 of the projector constitutes the outlet for the sound vibrations. Annular gaskets 90 and 92 are usually located upon opposite sides of the periphery of the diaphragm, and fasteners 94 simultaneously assemble the diaphragm, gaskets and projector to the housing flange.

In operation, energization of the coil 38 draws the plunger 52 into the coil bore producing diaphragm movement. The switch responds to the plunger movement to cut off current to the coil to allow a return movement of the diaphragm whereupon the switch is closed to repeat the cycle, resulting in diaphragm vibration. The diaphragm movement varies the gap 96 defined by the pole piece surface 36 and the plunger surface 64. The gap must be small for the magnetic attraction of the plunger to be most effective and thus to yield a high sound level for a given input voltage. If, however, the gap is too small the plunger will hit the pole piece to produce an undesirable sound quality. It is required that the plunger must not contact the pole piece at some specified maximum voltage.

A second type of horn assembly differs from the FIG. 1 structure in the mounting of the pole piece. As shown in FIG. 2 the bottom wall 20' of the housing 10' has a central aperture 21 with an outwardly turned flange 23. A pole piece 28' fits within the aperture 21 with an interference fit. Thus the pole piece is securely held but can be slidably adjusted in the housing by the application of force. The outer end of the pole piece 28' terminates in a cap 29.

In its preferred embodiment, the invention requires that the horn be initially assembled with the air gap smaller than its desired final size. To automatically adjust the gap a predetermined constant current is fed to the coil to cause the plunger to be attracted against the pole piece and held there by magnetic force. Then the pole piece is pulled away from the diaphragm until the diaphragm exerts sufficient mechanical force to overcome the magnetic attractive force and pulls away the plunger. At that point of breaking the contact the gap is at its optimum size if the coil current has been properly chosen. If the metal housing has been deformed to adjust the pole piece some spring back can be expected. In that case the pole piece is pulled further by a prescribed amount to compensate for spring back and when the pole piece is released the gap will return to the value it had when the plunger pulled away from the pole piece. In general, the calibration current determines a point of breaking contact which represents a functional datum point. That datum point may represent the correct gap or a gap which is undersize by a constant amount for any horn of a given type. The calibration setup for each horn type will determine how much, if any, additional pole piece movement should occur after the detection of the breaking of the contact.

The success of the method depends on detecting the event of breaking contact. The separation of the pole piece and the plunger abruptly changes the reluctance of the magnetic path and this results in transients in the coil current as well as a change in the flux leakage from the horn housing. The preferred technique for sensing the event is to monitor the current supplied to the coil and detect the transient caused by breaking contact between the pole piece and the plunger. It is also possible to sense the flux leakage from the horn and detect a change in flux caused by the breaking contact event.

The proper current to use during the calibration is on the order of the operational horn current, and is chosen to be less than the saturation current for the magnetic circuit. For a typical automobile horn it was found that the saturation began at about 14 amperes, and a calibration current of 10 amperes yielded excellent results in adjusting the air gap. For each type of horn the current is empirically determined for the desired sound quality and other customer specifications. Once the proper current is determined all horns of the same type can be adjusted with that current.

Apparatus for automatically adjusting the gap of a horn is shown schematically in FIG. 3. A pneumatic lift 150 operated by a servo valve 151 includes a fixture 152 which is configured to hold the horn in a particular orientation and lift it into a calibration station 153. There an anvil 154 seats against a shoulder surrounding the bottom wall 20 of the housing 10 so that the stem 30 protrudes upwardly through a central aperture in the anvil 154. A hydraulically operated gripper 156 is supported by a gear drive pulling mechanism 158 mounted on a support 160 above the anvil 154. A stepper motor 162 is coupled to the pulling mechanism 158 so that for each increment of motor movement the pulling mechanism will retract by some preset amount, say 0.001 inch. A pulse stepper controller 164 supplies the pulses to the stepper motor 162. An electrical coupler 166 attached to the anvil connects to the coil of the horn through the horn terminal when the horn is raised to the anvil. A controlled current supply 168 is coupled through a power switch 170 and current leads 172 to the electrical coupler 166. The current supply can be preset to any of several desired rates. A current sensor coil 174 is inductively coupled to the leads 172 and supplies a current change signal to a detector circuit 176. Position switches 178 sense the position of the lift 150. In practice they would be deployed to sense the full up and full down positions of the lift 150.

A programmable controller or computer 180 coordinates all the system components just enumerated. It receives input signals from the position switches 178 and the detector circuit 176. It issues control signals to the servo valve 151, the power switch 170 the detector circuit 176 and the pulse stepper control 164. The controller 180 is programmed to limit the number of pulses to the stepper motor to prevent over pull and damage to the horn in case of a faulty signal or an open circuit.

When the calibration procedure begins under operation of the controller 180 the lift servo valve 151 is commanded to actuate the lift to raise the horn to the anvil where the electrical connector 166 couples with the horn. There the position of the fixture is sensed and the gripper 156 is actuated to grasp the stem 30 of the pole piece. Then the controller 180 turns on the power switch 170 to supply current to the horn, and after waiting several milliseconds for the current to stabilize, it initiates a train of stepper pulses via the stepper controller 164 so that the pulling mechanism pulls up on the pole piece at a fixed rate.

When the current is applied to the coil the plunger is pulled into engagement with the pole piece. As the pole piece is pulled upwardly, the diaphragm force increases until it pulls the plunger away from the pole piece. This abrupt change in the magnetic circuit causes an inductive change resulting in a current transient. The sensor 174 picks up the transient and the detector circuit detects it.

The detector circuit 176 is shown in more detail in FIG. 4. The signal from the sensor 174 is fed through a pre-amp and noise filter circuit 182 which removes any spikes on the sensor signal. A first stage amplifier 184 and a second stage amplifier 186 amplify the signal and send it to a level detector 188 which turns on at a selected change in the input signal. A trigger indicator 190 is an LED for signaling that the condition has occurred. A signal delay circuit 192 such as an RC time delay issues an output to the controller 180 to stop the stepper motor 162. When the stepper motor is turned off the gap adjustment is complete.

The delay is optional. Its purpose is to extend the displacement of the pole piece enough to compensate for spring back of the housing, and is adjustable to suit the particular application. If the horn is of the FIG. 2 variety which does not experience spring back when the pole piece is released no time delay is necessary. Another option is to use a lower coil current so that the plunger disengagement occurs at a smaller gap size and then extend the time delay to make up the shortfall in pole piece displacement.

It will thus be seen that the method of air gap adjustment makes automatic calibration practical in a mass assembly environment and since it is accomplished after horn assembly by a functional test all the production variables are taken into account, thereby optimizing the horn output for the prescribed voltage input.

What is claimed is:

1. In the manufacture of an electric horn having an electromagnetic coil inductively coupled to a pole piece, a plunger magnetically attracted toward the pole piece and separated from the pole piece by a gap, and means for varying the gap between the pole piece and the plunger after horn assembly, the method of adjusting the gap comprising the steps of:

initially establishing the distance between the pole piece and the plunger at a value less than the desired gap, applying a predetermined current to the horn coil, the current being sufficient to bring the plunger into contact with the pole piece, moving the pole piece away from the plunger at least a sufficient amount in a direction to break said contact with the plunger, sensing the event of breaking said contact to establish, as a datum position, the position of said pole piece at the time of said event; and moving the pole piece relative to said datum position a distance depending upon the value of said current.

2. The method of claim 1 including the step of detecting the breaking of the contact between the plunger and the pole piece by sensing a change in coil current caused by breaking the contact.

3. The method of claim 1 including the step of detecting and breaking of the contact between the plunger and the pole piece by sensing a change in flux field leakage from the coil caused by breaking the contact.

4. The method of claim 1 wherein the horn has a sheet metal housing and the gap adjustment is accomplished by deforming the housing to move the pole piece, and the pole piece is moved an additional amount after breaking the contact with the plunger to compensate for spring back in the metal housing.

5. The method of claim 1 wherein the horn has a frictionally held pole piece and the gap adjustment is accomplished by moving the said pole piece relative to the housing and wherein no additional amount of pole piece movement is required after breaking the contact With the plunger.

6. In the manufacture of an electric horn having an electromagnetic coil inductively coupled to a pole piece, a plunger magnetically attracted toward the pole piece and separated from the pole piece by a gap, and means for varying the gap between the pole piece and the plunger after horn assembly, the method of adjusting the gap comprising the steps of;

initially assembling the horn with the gap between the pole piece and the plunger smaller than the desired gap, applying a predetermined current to the horn coil for holding the plunger in contact with the pole piece by magnetic force, moving the pole piece away from the plunger to overcome the magnetic force and break the contact, sensing the event of breaking the contact, and moving the pole piece a fixed amount in the same direction after sensing the event of breaking the contact, said amount depending upon the value of said current.

7. The method of claim 6 wherein the pole piece is moved away from the plunger at a fixed rate and the pole piece is moved at a predetermined rate for a preset time after sensing the breaking of the contact to obtain the desired gap.

8. The method of claim 6 wherein the event of breaking the contact is sensed by detecting changes in the applied current.

* * * * *

UNITED STATES PATENT AND TRADEMARK OFFICE

CERTIFICATE OF CORRECTION

PATENT NO. : 4,813,123

DATED : March 21, 1989

INVENTOR(S) : Wilson, et al

It is certified that error appears in the above-identified patent and that said Letters Patent is hereby corrected as shown below:

Column 6, line 15, delete "and" and insert -- the --.

Line 29, delete "With " insert -- with --.

Signed and Sealed this

Twenty-seventh Day of March, 1990

*Attest:*

JEFFREY M. SAMUELS

*Attesting Officer*

*Acting Commissioner of Patents and Trademarks*